US005487189A

United States Patent [19]

Bell

[11] Patent Number: 5,487,189

[45] Date of Patent: Jan. 30, 1996

[54] COVERALLS HAVING REDUCED SEAMS AND SEAMLESS SHOULDER CONSTRUCTION AND METHOD OF MANUFACTURE

[75] Inventor: Richard H. Bell, Tucson, Ariz.

[73] Assignee: Kimberly-Clark Corporation, Neenah, Wis.

[21] Appl. No.: 214,871

[22] Filed: Mar. 16, 1994

[51] Int. Cl.[6] ..... A41D 1/06

[52] U.S. Cl. ..... 2/79; 2/69; 2/114; 2/243.1

[58] Field of Search ..... 2/79, 69, 114, 2/69.5, 2, 243.1, 51, 84, 87

[56] References Cited

U.S. PATENT DOCUMENTS

| | | | |
|---|---|---|---|
| D. 236,293 | 8/1975 | Banks . | |
| 2,497,764 | 2/1950 | Doughty . | |
| 2,579,275 | 12/1951 | Schworn, Jr. . | |
| 2,976,182 | 3/1961 | Caldwell et al. . | |
| 2,982,969 | 5/1961 | Parker et al. | 2/84 |
| 3,100,897 | 8/1963 | Langer | 2/84 |
| 3,570,012 | 3/1971 | Winters . | |
| 3,654,632 | 4/1972 | Lacroix . | |
| 3,711,865 | 1/1973 | Schifman | 2/79 |
| 3,720,957 | 3/1973 | Patience . | |
| 3,772,705 | 11/1973 | Angel et al. | 2/79 |
| 3,849,802 | 11/1974 | Govaars | 2/84 |
| 3,946,443 | 3/1976 | Knight | 2/84 |
| 4,124,903 | 11/1978 | Shaw | 2/84 |
| 4,303,712 | 12/1981 | Woodroof . | |
| 4,338,371 | 7/1982 | Dawn et al. . | |
| 4,443,511 | 4/1984 | Worden et al. . | |
| 4,454,191 | 6/1984 | VonBilcher et al. . | |
| 4,493,870 | 1/1985 | Vrouenraets et al. . | |
| 4,539,255 | 9/1985 | Sato et al. . | |
| 4,670,913 | 6/1987 | Morell et al. . | |
| 4,705,717 | 11/1987 | Cain et al. . | |
| 4,713,068 | 12/1987 | Wang et al. . | |
| 4,725,481 | 2/1988 | Ostapchenko . | |
| 4,758,239 | 7/1988 | Yeo et al. . | |
| 4,772,510 | 9/1988 | McClure . | |
| 4,791,685 | 12/1988 | Maibauer . | |
| 4,829,602 | 5/1989 | Harreld et al. . | |
| 4,833,010 | 5/1989 | Langley . | |

(List continued on next page.)

FOREIGN PATENT DOCUMENTS

| | | |
|---|---|---|
| 59-159338 | 9/1984 | Japan . |
| 62-028475 | 2/1987 | Japan . |
| 62-064833 | 3/1987 | Japan . |
| 2-276636 | 11/1990 | Japan . |

*Primary Examiner*—C. D. Crowder
*Assistant Examiner*—Gloria Hale
*Attorney, Agent, or Firm*—Karl V. Sidor

[57] ABSTRACT

Disclosed is disposable protective coveralls having a reduced number of seams and a seamless shoulder construction. The disposable protective coveralls include a first body half and a second body half. Each body half is formed from a seamless sheet of material. The second body half is substantially a mirror image of the first body half. Each body half includes: 1) a body portion having a first and second edge and a top edge extending approximately half-way across the body portion from the second edge; 2) a sleeve portion having a top and bottom sleeve edge, a top edge, and a segment of the second edge of the body portion; and 3) a leg portion having a front and a rear leg edge. The protective coveralls' construction also includes approximately eight seams and a closure. More particularly, body halves are united into protective coveralls by: a closure joining the first edges of each body portion on each body half; a seam joining the second edges of the body portion, including the segment of the second edges in the sleeve portions, on each body half; sleeve seams joining the top sleeve edges to the bottom sleeve edges on each body half; inseams joining the front leg edges to the back leg edges on each body half; and back seams joining each top edge of a sleeve portion with the top edge of its respective body portion on each body half. Also disclosed is a method of making protective coveralls having a reduced number of seams and a seamless shoulder construction.

20 Claims, 5 Drawing Sheets

U.S. PATENT DOCUMENTS 4,855,178 8/1989 Langley .
4,857,393 8/1989 Kato et al. .
4,860,382 8/1989 Markwell ..... 2/79
4,863,788 9/1989 Bellairs et al. .
4,871,600 10/1989 Amann .
4,871,611 10/1989 LeBel .
4,872,220 10/1989 Haruvy et al. .
4,908,260 3/1990 Dodia et al. .
4,935,287 6/1990 Johnson et al. .
4,943,473 7/1990 Sahatjian et al. .
4,943,475 7/1990 Baker et al. .
4,970,105 11/1990 Smith, Jr. .
4,981,738 1/1991 Farnworth et al. .
5,024,594 6/1991 Athayde et al. .
5,082,721 1/1992 Smith, Jr. et al. .
5,190,806 3/1993 Nomi .
5,204,156 4/1993 Lumb et al. .
5,208,313 5/1993 Krishnan .
5,234,525 8/1993 Krishnan .

COVERALLS HAVING REDUCED SEAMS AND SEAMLESS SHOULDER CONSTRUCTION AND METHOD OF MANUFACTURE

FIELD OF THE INVENTION

The present invention relates to protective apparel. The present invention also relates to a process for making protective apparel.

BACKGROUND

There are many types of limited use or disposable protective apparel designed to provide barrier properties. One type of protective apparel is protective coveralls. Coveralls can be used to effectively seal off a wearer from a harmful environment in ways that open or cloak style garments such as, for example, drapes, gowns and the like are unable to do. Accordingly, coveralls have many applications where isolation of a wearer is desirable. For a variety of reasons, it is undesirable for hazardous liquids and/or pathogens which may be carried by liquids to pass through protective apparel. It is also highly desirable to use protective apparel to isolate persons from dusts, powders, and other particulates which may be present in a work place or accident site. Generally speaking, protective apparel rely on the barrier properties of the fabrics used in their construction. Some of these fabrics may even have received treatments to enhance barrier properties. However, barrier performance of protective apparel also depends on the design and construction of the apparel. Apparel containing many seams may be unsatisfactory, especially if the seams are located in positions where they may be subjected to stress and/or direct contact with hazardous substances. For example, seams that join sleeves to the body portion of protective coveralls are often subjected to stress. Moreover, sleeve seams in the front of coveralls and about the shoulder are at locations of frequent accidental splashing, spraying and/or other exposures. After use, it can be quite costly to decontaminate protective apparel that has been exposed to hazardous substances. Thus, it is important that protective apparel be inexpensive so as to be disposable. Generally speaking, protective coveralls are made from barrier materials/fabrics engineered to be relatively impervious to liquids and/or particulates. The cost of such materials as well as the coveralls' design and construction are important factors affecting cost. Desirably, all of these factors should be suited for the manufacture of protective coveralls at such low cost that it may be economical to discard the coveralls after only a single use.

Protective coveralls must be worn correctly to reduce the chance of exposure. Workers are more likely to wear protective coveralls properly if the coveralls are comfortable. One way to increase comfort is to have the coveralls fit well. Protective coveralls containing many separate panels, pieces, dissimilar materials and/or elastic components may tend to fit well but are generally more complex and difficult to manufacture quickly. Complex and relatively inefficient manufacturing processes can eliminate the cost advantages provided by inexpensive materials. Moreover, an increased number of seams and/or the presence of dissimilar materials can increase the chance of exposure. Thus, a need exists for inexpensive protective coveralls having desirable barrier properties, a reduced number of seams and a seamless shoulder construction. There is still a need for such protective coveralls suited for high-speed manufacturing and converting processes. For example, a need exists for protective coveralls manufactured from two seamless sheets of an inexpensive barrier material such that the coveralls are relatively impermeable to liquids and/or particulates and so inexpensive as to be disposable while also having a reduced number of seams and a seamless shoulder construction.

DEFINITIONS

As used herein, the term "nonwoven web" refers to a web that has a structure of individual fibers or filaments which are interlaid, but not in an identifiable repeating manner. Nonwoven webs have been, in the past, formed by a variety of processes known to those skilled in the art such as, for example, meltblowing, spunbonding and bonded carded web processes.

As used herein, the term "spunbonded web" refers to a web of small diameter fibers and/or filaments which are formed by extruding a molten thermoplastic material as filaments from a plurality of fine, usually circular, capillaries in a spinnerette with the diameter of the extruded filaments then being rapidly reduced, for example, by non-eductive or eductive fluid-drawing or other well known spunbonding mechanisms. The production of spunbonded nonwoven webs is illustrated in patents such as Appel, et al., U.S. Pat. No. 4,340,563; Dorschner et al., U.S. Pat. No. 3,692,618; Kinney, U.S. Pat. Nos. 3,338,992 and 3,341,394; Levy, U.S. Pat. No. 3,276,944; Peterson, U.S. Pat. No. 3,502,538; Hartman, U.S. Pat. No. 3,502,763; Dobo et al., U.S. Pat. No. 3,542,615; and Harmon, Canadian Patent No. 803,714.

As used herein, the term "meltblown fibers" means fibers formed by extruding a molten thermoplastic material through a plurality of fine, usually circular, die capillaries as molten threads or filaments into a high-velocity gas (e.g. air) stream which attenuates the filaments of molten thermoplastic material to reduce their diameters, which may be to microfiber diameter. Thereafter, the meltblown fibers are carried by the high-velocity gas stream and are deposited on a collecting surface to form a web of randomly disbursed meltblown fibers. The meltblown process is well-known and is described in various patents and publications, including NRL Report 4364, "Manufacture of Super-Fine Organic Fibers" by V. A. Wendt, E. L. Boone, and C. D. Fluharty; NRL Report 5265, "An Improved device for the Formation of Super-Fine Thermoplastic Fibers" by K. D. Lawrence, R. T. Lukas, and J. A. Young; and U.S. Pat. No. 3,849,241, issued Nov. 19, 1974, to Buntin, et al.

As used herein, the term "microfibers" means small diameter fibers having an average diameter not greater than about 100 microns, for example, having a diameter of from about 0.5 microns to about 50 microns, more specifically microfibers may also have an average diameter of from about 1 micron to about 20 microns. Microfibers having an average diameter of about 3 microns or less are commonly referred to as ultra-fine microfibers. A description of an exemplary process of making ultra-fine microfibers may be found in, for example, U.S. Pat. No. 5,213,881, entitled "A Nonwoven Web With Improved Barrier Properties", incorporated herein by reference in its entirety.

As used herein, the term "sheet" refers to a material that may be a film, nonwoven web, woven fabric or knit fabric.

As used herein, the term "disposable" is not limited to single use articles but also refers to articles that can be discarded if they become soiled or otherwise unusable after only a few uses.

As used herein, the term "machine direction" refers to the planar dimension of a nonwoven fibrous web which is in the direction of travel of the forming surface onto which fibers are deposited during formation of the web.

As used herein, the term "cross-machine direction" refers to the planar dimension of a nonwoven fibrous web which is in the direction that is perpendicular to the machine direction defined above.

As used herein, the term "liquid resistant" refers to material having a hydrostatic head of at least about 25 centimeters as determined in accordance with the standard hydrostatic pressure test AATCCTM No. 127–1977 with the following exceptions: (1) the samples are larger than usual and are mounted in a stretching frame that clamps onto the cross-machine direction ends of the sample, such that the samples may be tested under a variety of stretch conditions (e.g., 10%, 20%, 30%, 40% stretch); and (2) the samples are supported underneath by a wire mesh to prevent the sample from sagging under the weight of the column of water.

As used herein, the term "breathable" refers to material having a Frazier porosity of at least about 25 cubic feet per minute per square foot (cfm/ft$^2$). For example, the Frazier porosity of a breathable material may be from about 25 to more than 45 cfm/ft$^2$. The Frazier porosity is determined utilizing a Frazier Air Permeability Tester available from the Frazier Precision Instrument Company. The Frazier porosity is measured in accordance with Federal Test Method 5450, Standard No. 191A, except that the sample size is 8"×8" instead of 7"×7".

As used herein, the term "particle resistant" refers to a fabric having a useful level of resistance to penetration by particulates. Resistance to penetration by particulates may be measured by determining the air filter retention of dry particles and can be expressed as a particles hold-out efficiency. More specifically, particle hold-out efficiency refers to the efficiency of a material at preventing the passage of particles of a certain size range through the material. Particle hold-out efficiency may be measured by determining the air filter retention of dry particles utilizing tests such as, for example, IBR Test Method No. E-217, Revision G (1/15/91) performed by InterBasic Resources, Inc. of Grass Lake, Mich. Generally speaking, a high particle hold-out efficiency is desirable for barrier materials/fabrics. Desirably, a particle resistant material should have a particle hold-out efficiency of at least about 40 percent for particles having a diameter greater than about 0.1 micron.

As used herein, the term "polymer" generally includes, but is not limited to, homopolymers, copolymers, such as, for example, block, graft, random and alternating copolymers, terpolymers, etc. and blends and modifications thereof. Furthermore, unless otherwise specifically limited, the term "polymer" shall include all possible geometrical configurations of the material. These configurations include, but are not limited to, isotactic, syndiotactic and random symmetries.

As used herein, the term "consisting essentially of" does not exclude the presence of additional materials which do not significantly affect the desired characteristics of a given composition or product. Exemplary materials of this sort would include, without limitation, pigments, antioxidants, stabilizers, surfactants, waxes, flow promoters, particulates or materials added to enhance processability of a composition.

SUMMARY OF THE INVENTION

The problems described above are addressed by protective coveralls having a reduced number of seams and a seamless shoulder construction. The protective coveralls include a first body half and a second body half. Each body half is formed from a seamless sheet of material. The second body half is substantially a mirror image of the first body half. Each body half includes: 1) a body portion having a first and second edge and a top edge extending approximately half-way across the body portion from the second edge; 2) a sleeve portion having a top and bottom sleeve edge, a top edge, and a segment of the second edge of the body portion; and 3) a leg portion having a front and a rear leg edge. The protective coveralls' construction also includes approximately eight seams and a closure. More particularly, body halves are united into protective coveralls by: a closure joining the first edges of each body portion on each body half; a seam joining the second edges of the body portion, including the segment of the second edges in the sleeve portions, on each body half; sleeve seams joining the top sleeve edges to the bottom sleeve edges on each body half; inseams joining the front leg edges to the back leg edges on each body half; and back seams joining each top edge of a sleeve portion with the top edge of its respective body portion on each body half.

In one aspect of the invention, the protective coveralls may be adapted to be liquid resistant, particle resistant and/or breathable.

The seamless sheet of material used to form a body half may be selected from a bonded carded web, a web of spunbonded fibers, a web of meltblown fibers, and a film. The seamless sheet of material maybe formed from a polymer selected from polyamides, polyolefins, polyesters, polyvinyl alcohols, polyurethanes, polyvinyl chlorides, polyfluorocarbons, polystyrenes, caprolactams, copolymers of ethylene and at least one vinyl monomer, copolymers of ethylene and n-butyl acrylate, and cellulosic and acrylic resins, and mixtures and blends of the same. If the seamless sheet of material is a polyolefin, it may be selected from polyethylene, polypropylene, polybutene, ethylene copolymers, propylene copolymers and butene copolymers.

The seamless sheet of material used to form a body half may be a laminate. For example, the seamless sheet of material may be a laminate of two or more nonwoven webs. As a further example, the seamless sheet material may be a laminate of at least one web of spunbonded fibers and at least one web of meltblown fibers and mixtures thereof. The seamless sheet of material may also be a laminate composed of at least one nonwoven web and at least one film layer. Generally speaking, the film layer may range in thickness from about 0.25 mil to about 5.0 mil. For example, the film will have a thickness ranging from about 0.5 mil to about 3.0 mil. Desirably, the film will have a thickness ranging from about 1.0 mil to about 2.5 mil.

Exemplary film layers include films formed from polymers which may include polyamides, polyolefins, polyesters, polyvinyl alcohols, polyurethanes, polyvinyl chlorides, polyfluorocarbons, polystyrenes, caprolactams, copolymers of ethylene and at least one vinyl monomer, copolymers of ethylene and n-butyl acrylate, and cellulosic and acrylic resins. If the film layer is made of a polyolefin, the polyolefin may be polyethylene, polypropylene, polybutene, ethylene copolymers, propylene copolymers and butene copolymers and blends of the above.

According to the invention, the seamless sheet of material may have a basis weight ranging from about 15 gsm (i.e., grams per square meter) to about 300 gsm. Desirably, the seamless sheet of material may have a basis weight ranging from about 20 gsm to about 75 gsm.

In another aspect of the invention, the protective coveralls may contain elasticizing means on portions of the coveralls at the wrists and ankles of a wearer. For example, the protective coveralls may contain elastic cuffs at the wrists and/or ankles. Alternatively and/or additionally, elastic strips about the circumference of the outermost portion of the wrist opening and/or ankle openings of the coveralls.

Generally speaking, the seams in the garment may be any suitable seams such as, for example, seams formed by sewing or stitching, ultrasonic bonding, solvent welding, adhesives, thermal bonding and the like. The closure means may be any suitable closure mechanism such as, for example, zippers, button fasteners, clip fasteners, snap fasteners, hook and loop fasteners and the like.

The present invention also encompasses a method of making protective coveralls having a reduced number of seams and a seamless shoulder construction. The method of the present invention includes the steps of: 1) providing a first body half and a second body half, each composed of a seamless sheet of material, said second body half being substantially a mirror image of said first body half, and each body half including: a) a body portion having a first and second edge and a top edge extending approximately half-way across the body portion from the second edge; b) a sleeve portion having a top and bottom sleeve edge, a top edge, and a segment of the second edge of the body portion; and c) a leg portion having a front and a rear leg edge; 2) folding each sleeve portion substantially in half down its length; 3) folding each body portion and leg portion substantially in half down their lengths; 4) attaching the top edge of a sleeve portion to the top edge of its respective body portion on each body half; 5) attaching the top sleeve edge to a respective bottom sleeve edge on a sleeve portion on each body half; 6) attaching the second edges of respective body portions of each body half; 7) attaching a closure means to respective first edges of each body half; and 8) attaching the front leg edge to the back leg edge of respective leg portions on each body half.

According to the method of the present invention, attachment of the various portions of the garment may be achieved utilizing sewing or stitching, ultrasonic bonding, solvent welding, adhesives, thermal bonding and similar techniques. The present invention also contemplates a process which includes the steps of attaching features such as, for example, a collar, a hood, boots and/or elastic cuffs.

DETAILED DESCRIPTION

Figure 1:
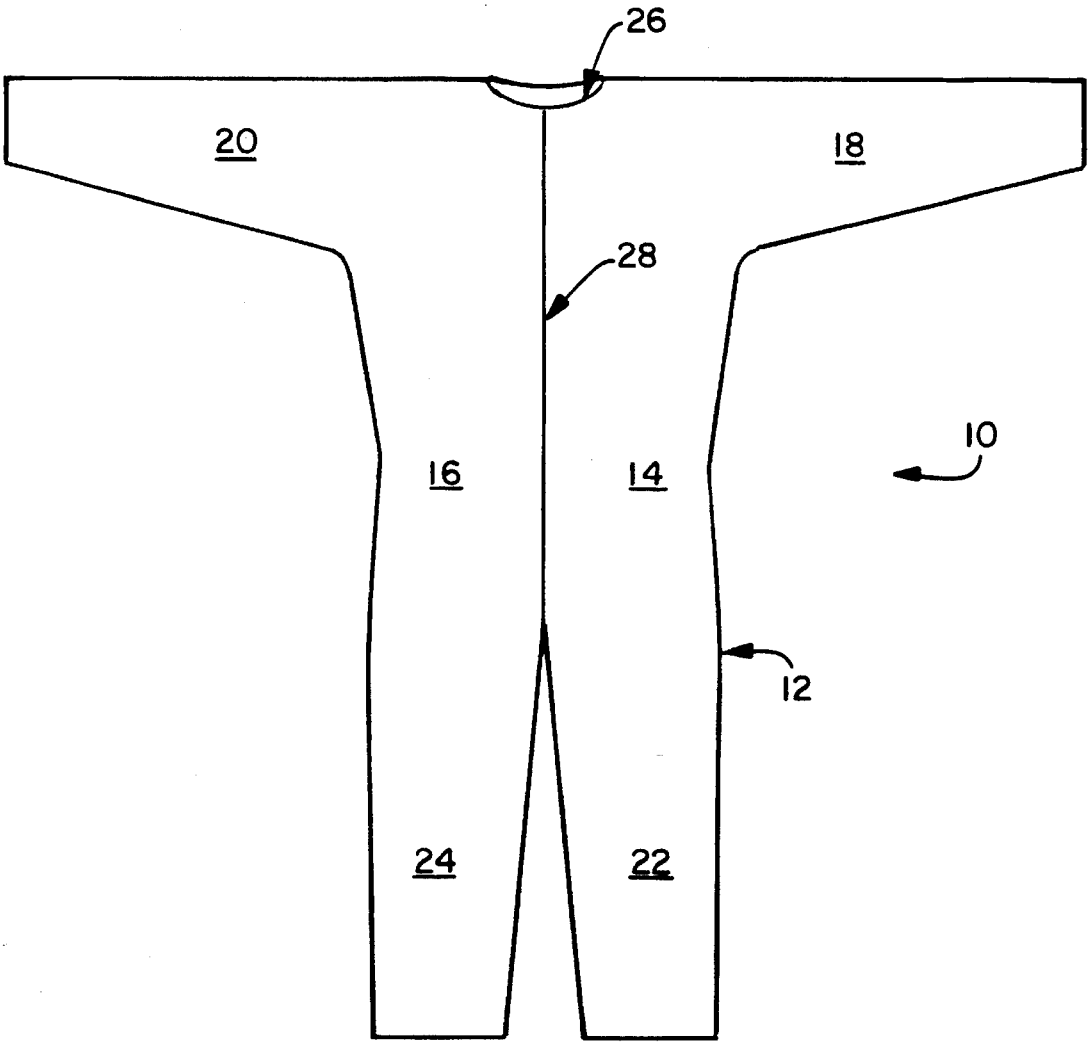
FIG. 1 illustrates a front view of exemplary protective coveralls.

The present invention is directed to protective coveralls. FIG. 1 illustrates at 10 a front view of an exemplary protective coveralls having a reduced number of seams and a seamless shoulder construction.

The protective coveralls 12 include a first body half 14 and a second body half 16. Each body half 14 and 16 is formed from a seamless sheet of material. The second body half 16 is substantially a mirror image of the first body half 14. The protective coveralls contains sleeves 18 and 20 as well as legs 22 and 24 A neck opening 26 is visible at the top of the coveralls 12. As shown in FIG. 1, only a closure means 28 is visible from a front view of the coveralls 12.

Figure 2:
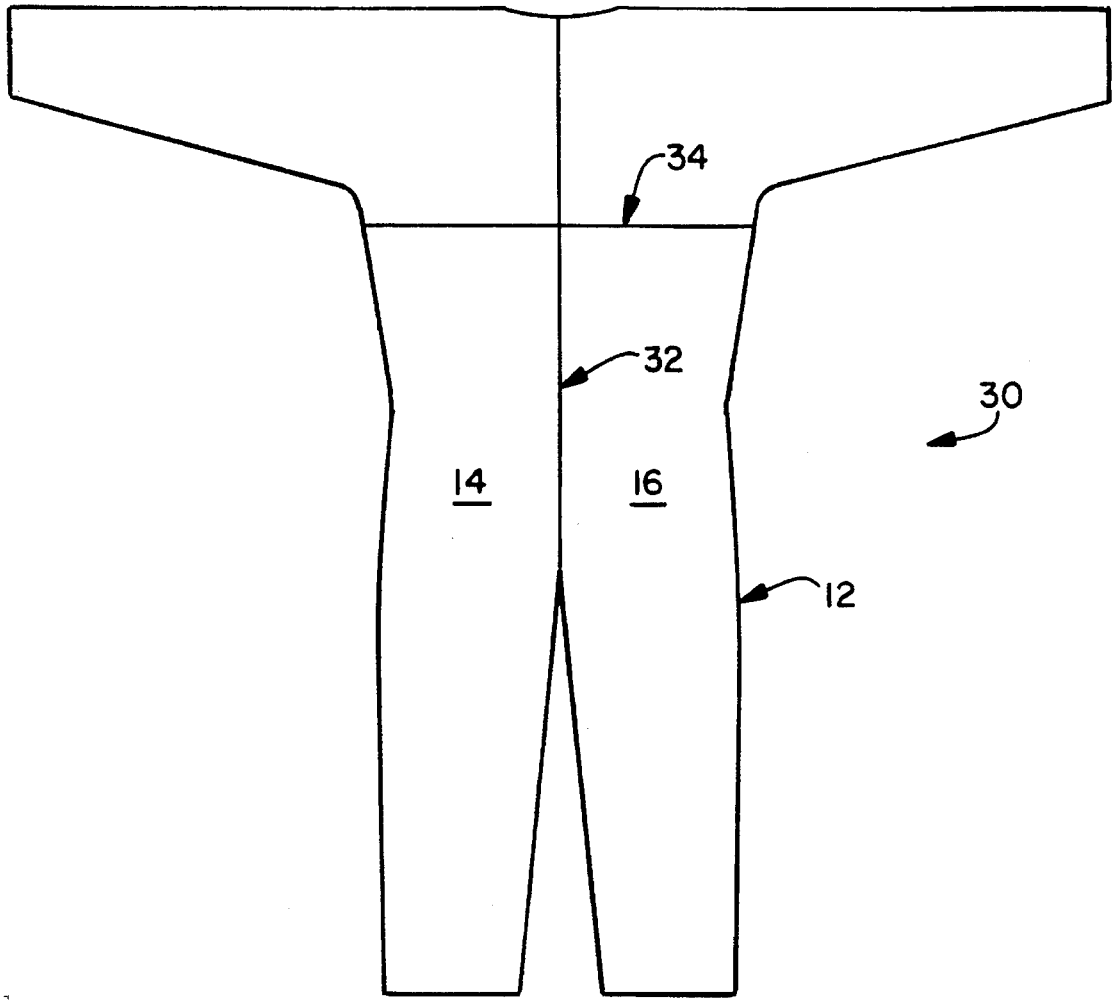
FIG. 2 illustrates a rear view of exemplary protective coveralls.

FIG. 2 illustrates at 30 a rear view of an exemplary protective coveralls having a reduced number of seams and a seamless shoulder construction. The protective coveralls 12 includes a first body half 14 and a second body half 16 (in reversed position as the view is from the rear). The sleeves 18 and 20 and the legs 22 and 24 are also in reversed position. As shown in FIG. 2, only a vertical seam 32 and a back seam 34 are visible from a rear view of the coveralls 12.

Figure 3:
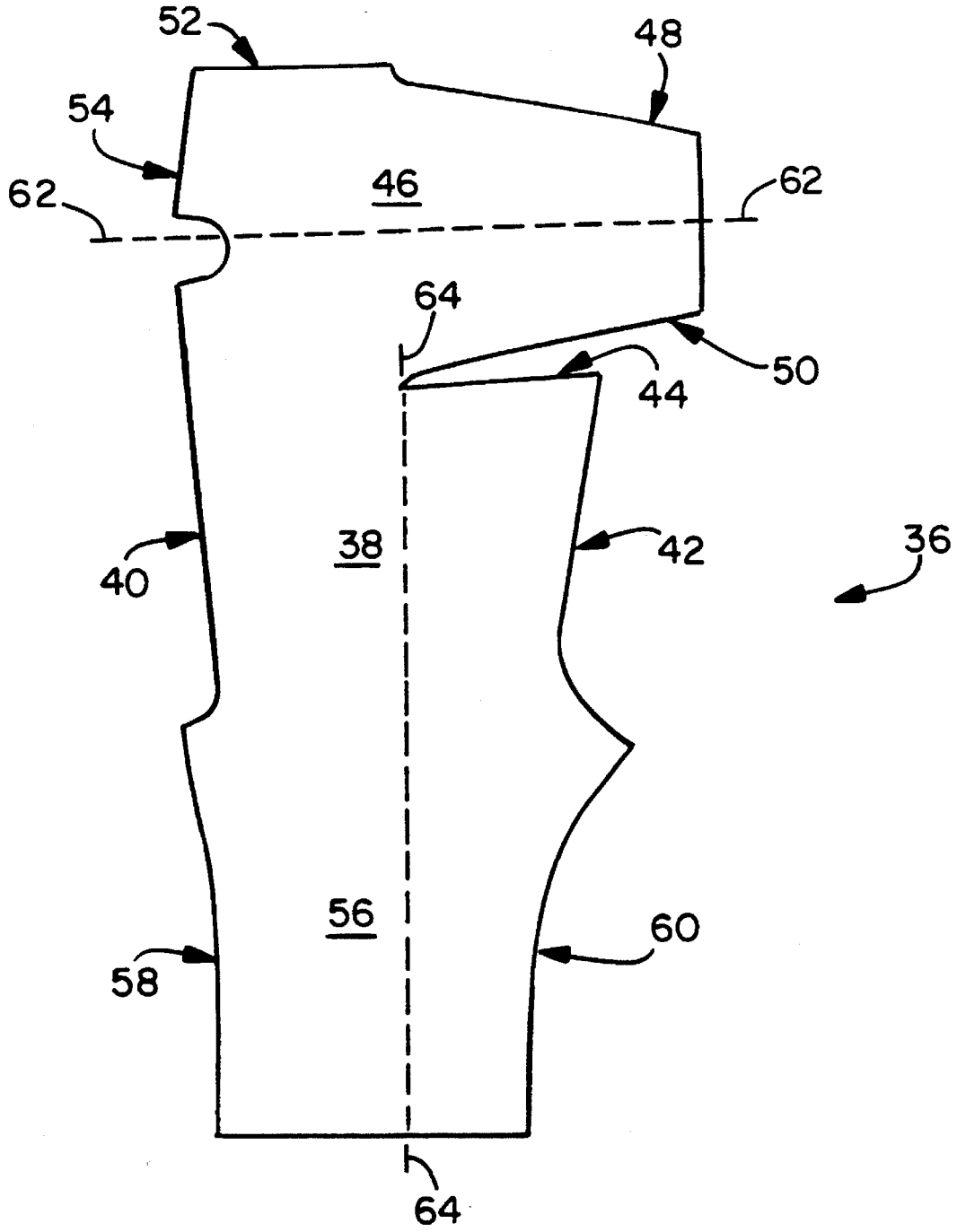
FIG. 3 illustrates a detail of exemplary protective coveralls.

Referring now to FIG. 3, there is shown at 36 a seamless sheet of material used to form a body half 14. The body half 14 includes a body portion 38 having a first edge 40, a second edge 42 and a top edge 44. The top edge 44 extends approximately half-way across the body portion 38 from the second edge 42.

The body half 14 includes a sleeve portion 46 having a top sleeve edge 48 and bottom sleeve edge 50, a top edge 52, and a segment 54 of the second edge 42 of the body portion 38. The body half 14 also includes a leg portion 56 having a front leg edge 58 and a rear leg edge 60.

Figure 5:
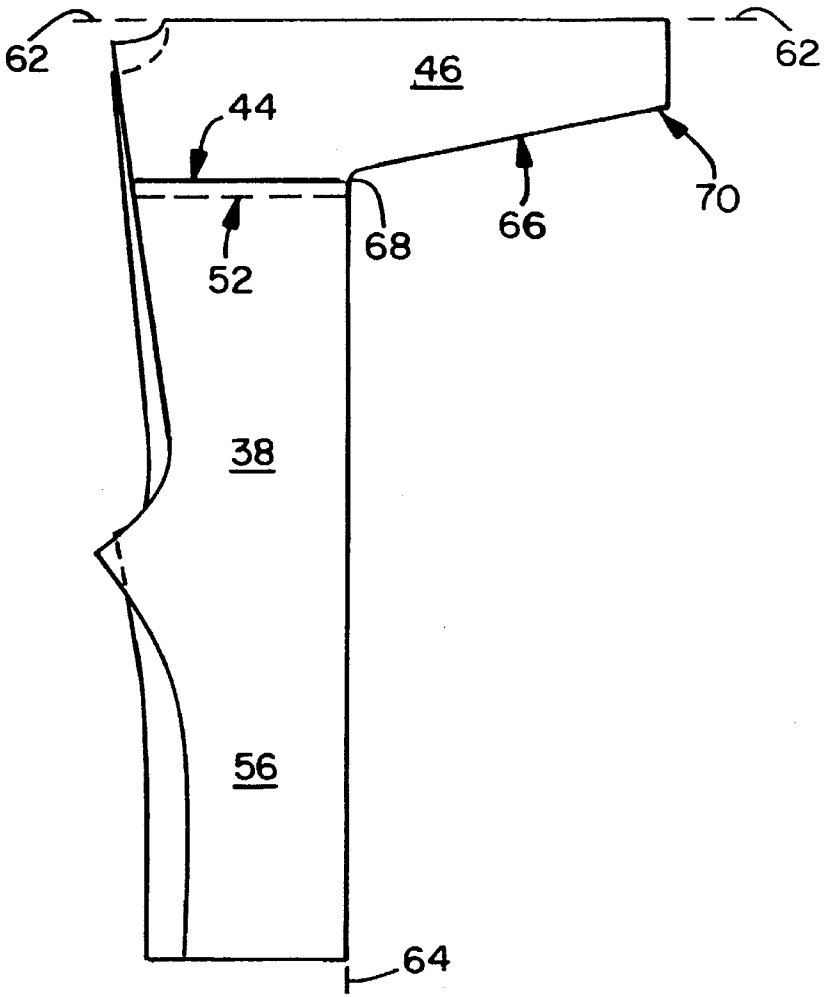
FIG. 5 illustrates a detail exemplary protective coveralls.
Figure 4:
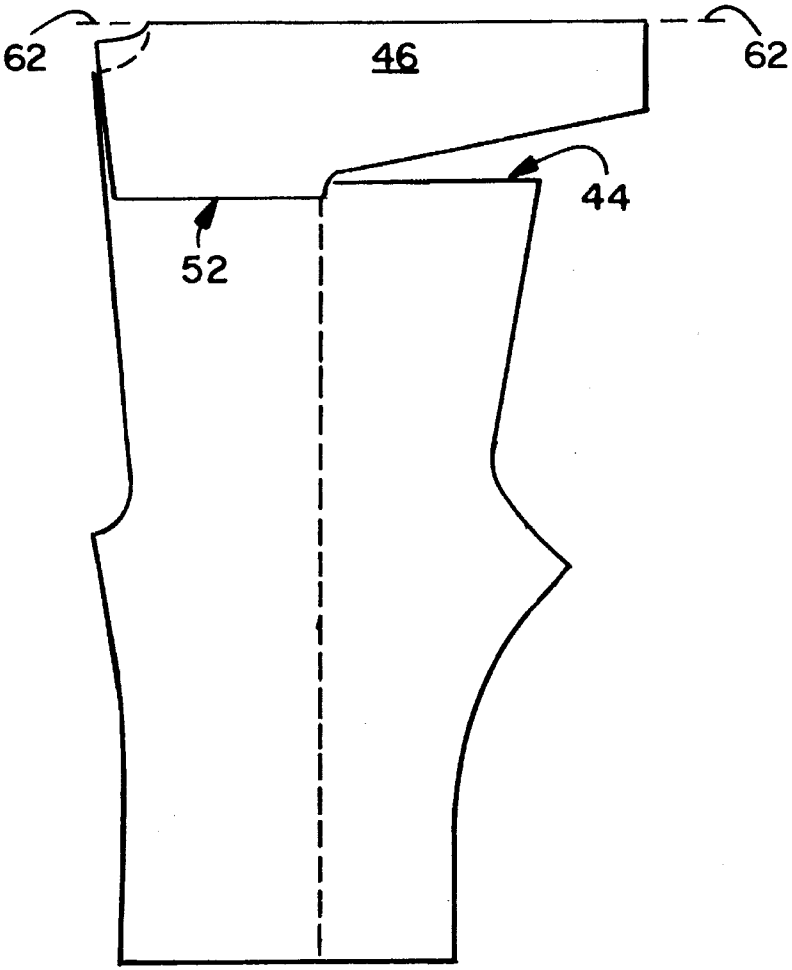
FIG. 4 illustrates a detail of exemplary protective coveralls.

A sleeve 18 of a body half 14 may be constructed by folding the sleeve portion 46 along line 62 as illustrated in FIG. 4. Next, the body portion 38 and leg portion 56 are folded along line 64 as illustrated in FIG. 5.

After these two folds are made, the top edge 52 of the sleeve portion 46 is attached to the top edge 44 of the body portion 38 producing a back seam 34 which can be seen in FIG. 1. Referring again to FIG. 5, the sleeve portion 46 is closed into a sleeve 18 by attaching the top sleeve edge 48 to the bottom sleeve 44 edge producing a sleeve seam 66 running from point 68 to point 70.

Figure 6:
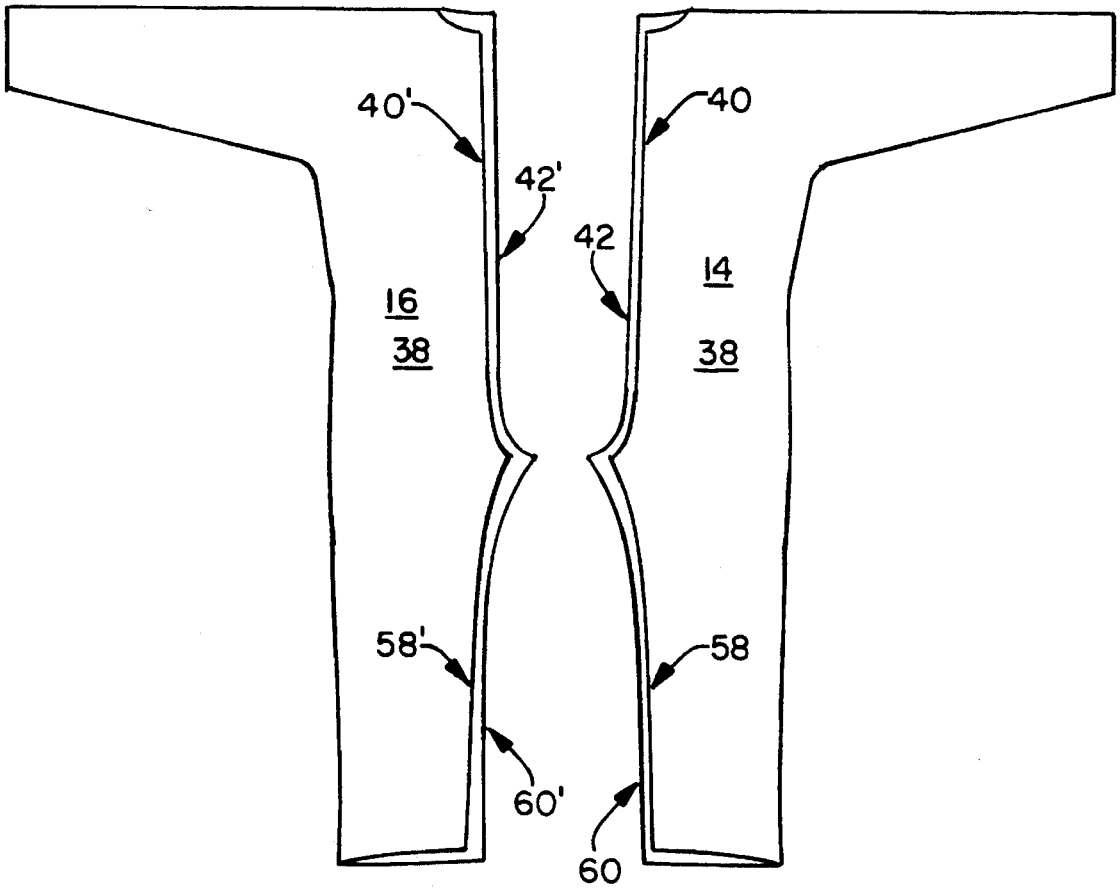
FIG. 6 illustrates a detail exemplary protective coveralls.

Generally speaking, this operation would be performed on the other body half 16 following exactly the same procedure as it would apply to the mirror image shape. Referring now to FIG. 6, the body half 14 is attached to body half 16 (i.e., the mirror image of body half 14). The body halves are joined by attaching the respective second surfaces 42 and 42' of the body portions 38 and 38'. A closure means (e.g., zipper, button fasteners, clip fasteners, snap fasteners, hook and loop fasteners and the like) 28 is attached to the respective first surfaces 40 and 40'. The leg portions are closed by attaching the front leg edge 58 to the back leg edge 60 and the front leg edge 58' to the back leg edge 60' on each body half.

At this point other features may be added such as, for example, a collar, hood, boots and/or elastic cuffs at the wrists and/or ankles of the coveralls.

When this method of construction is utilized, the protective coveralls construction contains approximately eight seams and a closure. More particularly, body halves are united into protective coveralls by: 1) a closure joining the first edges of each body portion on each body half; 2) a seam joining the second edges of the body portion, including the segment of the second edges in the sleeve portions, on each body half; 3) sleeve seams joining the top sleeve edges to the bottom sleeve edges on each body half; 4) inseams joining the front leg edges to the back leg edges on each body half; and 5) back seams joining each top edge of a sleeve portion with the top edge of its respective body portion on each body half.

The coveralls includes a neck opening in a shoulder line at its top. The neck opening may be fitted with a collar and/or hood. Sleeve and leg portions extending from the body portion may be fitted with elastic cuffs and/or other elastic means to ensure that they fit snugly against a wearer.

Generally speaking, the manufacture of such coveralls may be in accordance with known automated, semi-automated, or hand assembly procedures. For example, attachment of the various portions of the garment may be achieved utilizing sewing or stitching, ultrasonic bonding, solvent welding, adhesives, thermal bonding and similar techniques.

The order of manufacturing steps described above are believed to provide an efficient process for fabricating protective coveralls. However, it is contemplated that changes in the order of these steps may be made without departing from the spirit and scope of the present invention.

The seamless sheet of material used in the construction of the protective coveralls may be one or more bonded carded webs, webs of spunbonded filaments, webs of meltblown fibers. The seamless sheet material may also be one or more knit or woven materials. It is contemplated that the seamless sheet material may be one or more films.

The seamless sheet material (e.g., nonwoven webs, woven materials, knit materials or films) may be formed from polymers such as, for example, polyamides, polyolefins, polyesters, polyvinyl alcohols, polyurethanes, polyvinyl chlorides, polyfluorocarbons, polystyrenes, caprolactams, poly(ethylene vinyl acetates), ethylene n-butyl acrylates, and cellulosic and acrylic resins. If the nonwoven web is formed from a polyolefin, the polyolefin may be polyethylene, polypropylene, polybutene, ethylene copolymers, propylene copolymers and butene copolymers.

The seamless sheet material (e.g., the nonwoven webs, woven materials, knit materials or films) may have a basis weight ranging from about 15 gsm to about 300 gsm. For example, the seamless sheet material may have a basis weight ranging from about 25 gsm to about 100 gsm. Desirably, the seamless sheet material may have a basis weight ranging from about 20 gsm to about 75 gsm.

An exemplary seamless sheet material that can be used in the manufacture of the protective coveralls of the present invention is a spunbonded polypropylene continuous filament web. This material can be formed utilizing a conventional spunbonding process and is available from the Kimberly-Clark Corporation, Neenah, Wis.

Another exemplary seamless sheet material is a high pulp content spunbonded continuous filament composite. Such a material may have a wide range of basis weights and can be composed of about 84 percent, by weight, pulp and about 16 percent, by weight, spunbonded polypropylene continuous filament web. This material can be formed essentially as described in U.S. Pat. No. 5,284,703, by C. H. Everhart, et al., entitled "High Pulp Content Nonwoven Composite Fabric", the entire content of which is incorporated herein by reference.

Yet another exemplary seamless sheet material may be a through-air bonded carded web, such as, for example a through-air bonded carded web composed of about 60 percent, by weight, polyester staple fibers and about 40 percent, by weight, bi-component polyethylene/polyester staple fibers. The web may be formed utilizing conventional carding equipment and bonded utilizing a conventional heated through-air treatment which causes thermal bonding of the fibers.

Generally speaking, these seamless sheet materials may be treated to improve resistance to liquid and reduce static buildup. For example, these materials may be treated with compositions such as Zepel® and Zelec®, available from E. I. du Pont De Nemours.

Multiple layers of seamless sheet material may be joined into a seamless laminate and used to form coveralls having desirable barrier properties. Laminates can be formed by combining layers of seamless sheet materials with each other and/or forming or depositing layers of such materials on each other.

For example, useful multi-layer materials may be made by joining at least one web of meltblown fibers (which may include meltblown microfibers) with at least one spunbonded continuous filament web. An exemplary multi-layer seamless material useful for making the protective coveralls of the present invention is a nonwoven laminated fabric constructed by bonding together layers of spunbonded continuous filaments webs and webs of meltblown fibers (which may include meltblown microfibers) and may also include a bonded carded web or other nonwoven fabric. This material is so inexpensive to produce that it may be considered to be a disposable material.

An exemplary three-layer fabric having a first outer ply of a spunbonded web, a middle ply of a meltblown web, and a second outer ply of a spunbonded web may be referred to in shorthand notation as SMS. The fibers and/or filaments in such fabrics may be polyolefins, polyesters, and polyamides. If polyolefins are used for the fibers and/or filaments, desirable polyolefins include polyethylene, polypropylene, polybutene, ethylene copolymers, polypropylene copolymers and butene copolymers, as well as blends and copolymers including the foregoing. Desirably, the polyolefin may be a random block copolymer of propylene and ethylene which contains about 3 percent or more, by weight, ethylene. The fibers and/or filaments may be formed from blends that contain various pigments, additives, strengthening agents, flow modifiers and the like. Such fabrics are described in U.S. Pat. Nos. 4,041,203, 4,374,888, and 4,753,843, the contents of which are incorporated herein by reference. Those patents are assigned to the Kimberly-Clark Corporation, the assignee of the present invention.

The multi-layer seamless sheet material may have a total basis weight of between about 15 gsm to about 300 gsm. For example, the multi-layer seamless sheet of material may have a basis weight ranging from about 40 gsm to about 175 gsm. Desirably, the multi-layer seamless sheet of material may have a basis weight ranging from about 50 gsm to about 150 gsm.

For example, the multi-layer seamless sheet of material may be a multi-layer nonwoven web of spunbond-meltblown-spunbond (SMS) construction in which each layer has a basis weight from about 9 gsm to about 70 gsm. Desirably, each layer may have a basis weight of from about 12 gsm to about 34 gsm. More desirably, each layer may have a basis weight of from about 14 gsm to about 27 gsm. To improve resistance to liquid and reduce static buildup, the material may also be treated with compositions such as Zepel® and Zelec®, available from E. I. du Pont De Nemours.

Exemplary multi-layer seamless sheet materials which may be used in the manufacture of the protective coveralls of the present invention include fabrics available from the Kimberly-Clark Corporation under the trade designation KLEENGUARD®. These fabrics are nonwoven laminated fabrics constructed by bonding together layers of spunbonded continuous filaments webs and webs of meltblown fibers (including meltblown microfibers). The fabrics may also include a bonded carded web or other nonwoven material. The KLEENGUARD® fabrics are typically composed of a first outer ply of a spunbonded polypropylene continuous filament web, a middle ply of a meltblown polypropylene web, and a second outer ply of a spunbonded polypropylene continuous filament web. These plies are joined together by conventional thermal bonding techniques utilizing heat and pressure. Such fabrics are described in U.S. Pat. Nos. 4,041,203, 4,374,888, and 4,753,843, the contents of which are incorporated herein by reference Desirably, the seamless sheet material (e.g., nonwoven webs, woven materials, or knit materials) includes at least one film layer. Generally speaking, the film will have a thickness ranging from about 0.25 mil to about 5.0 mil. For example, the film will have a thickness ranging from about 0.5 mil to about 3.0 mil. Desirably, the film will have a thickness ranging from about 1.0 mil to about 2.5 mil.

An exemplary material which could be used for the manufacture of disposable protective coveralls of the present invention is laminated fabric constructed by bonding together at least one layer of a nonwoven web with at least one layer of a film.

Generally speaking, this laminate may have a basis weight ranging from about 15 gsm to about 300 gsm. For example, the laminate may have a basis weight ranging from about 20 gsm to about 150 gsm.

As another example, the laminate may have a basis weight ranging from about 20 gsm to about 75 gsm. Although the basis weight of the laminate will vary depending on the materials used, lower basis weight materials are desirable for comfort and conformability, and higher basis weight materials are desirable for toughness and durability. The film-nonwoven web laminate construction permits combinations of materials providing high strength at relatively low basis weights and the design of the coveralls allows such strong and relatively unyielding materials to be used in a comfortable garment.

The films may be applied by extrusion coating the substrates and then passing the superposed materials through the nip of smooth calender rolls. The films may be formed so they would create a layer on the substrate having a desired thickness (excluding the substrate). Desirably, the films may be made of a polymer selected from polyamides, polyolefins, polyesters, polyvinyl alcohols, polyurethanes, polyvinyl chlorides, polyfluorocarbons, polystyrenes, caprolactams, poly(ethylene vinyl acetates), ethylene n-butyl acrylates, and cellulosic and acrylic resins. If the film is formed from a polyolefin, the polyolefin may be, for example, polyethylene, polypropylene, polybutene, ethylene copolymers, propylene copolymers and butene copolymers.

While the present invention has been described in connection with certain embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. Protective coveralls comprising:

a first body half and a second body half, each composed of a seamless sheet of material, said second body half being substantially a mirror image of said first body half, and each body half including:

a body portion having a first and second edge and a top edge extending approximately half-way across the body portion from the second edge;

a sleeve portion having a top and bottom sleeve edge, a top edge, and a segment of the second edge of the body portion; and a leg portion having a front and a rear leg edge;

closure means joining the first edges of each body portion on each body half;

a seam joining the second edges of the body portion, including the segment of the second edges in the sleeve portions, on each body half;

sleeve seams joining the top sleeve edges to the bottom sleeve edges on each body half;

inseams joining the front leg edges to the back leg edges on each body half; and back seams joining each top edge of a sleeve portion with the top edge of its respective body portion on each body half.

2. The disposable protective coveralls of claim 1, wherein the closure is selected from zippers, button fasteners, clip fasteners, snap fasteners and hook and loop fasteners.

3. The disposable protective garment of claim 1, wherein the garment is adapted to be liquid resistant.

4. The disposable protective garment of claim 1, wherein the garment is adapted to be breathable.

5. The disposable protective coveralls of claim 1, wherein the seamless sheet of material is selected from a bonded carded web, a web of spunbonded fibers, a web of meltblown fibers, and a film.

6. The disposable protective coveralls of claim 5, wherein the seamless sheet of material is formed from a polymer selected from polyamides, polyolefins, polyesters, polyvinyl alcohols, polyurethanes, polyvinyl chlorides, polyfluorocarbons, polystyrenes, caprolactams, copolymers of ethylene and at least one vinyl monomer, copolymers of ethylene and n-butyl acrylate, and cellulosic and acrylic resins, and mixtures and blends of the same.

7. The disposable protective coveralls of claim 6, wherein the polyolefin is selected from polyethylene, polypropylene, polybutene, ethylene copolymers, propylene copolymers and butene copolymers.

8. The disposable protective coveralls of claim 1, wherein the seamless sheet of material comprises a laminate.

9. The disposable protective coveralls of claim 8, wherein the laminate is selected from a laminate of at least one web of spunbonded fibers and at least one web of meltblown fibers and mixtures thereof.

10. The disposable protective coveralls of claim 8, wherein the laminate is composed of at least one nonwoven web and at least one film layer.

11. The disposable protective coveralls of claim 10, wherein the seamless sheet of material includes at least one film layer made of a polymer selected from polyamides, polyolefins, polyesters, polyvinyl alcohols, polyurethanes, polyvinyl chlorides, polyfluorocarbons, polystyrenes, caprolactams, copolymers of ethylene and at least one vinyl monomer, copolymers of ethylene and n-butyl acrylate, and cellulosic and acrylic resins.

12. The disposable protective coveralls of claim 11, wherein the film layer is a polyolefin selected from polyethylene, polypropylene, polybutene, ethylene copolymers, propylene copolymers and butene copolymers.

13. The disposable protective coveralls of claim 11, wherein the laminate includes a film layer having a thickness ranging from about 0.25 mil to about 5.0 mil.

14. The disposable protective coveralls of claim 1, wherein the seamless sheet of material has a basis weight ranging from about 15 gsm to about 300 gsm.

15. The disposable protective coveralls of claim 14, wherein the seamless sheet of material has a basis weight ranging from about 20 gsm to about 75 gsm.

16. The disposable protective coveralls of claim 1 further comprising elasticizing means on portions of the coveralls at the wrists and ankles of a wearer.

17. The disposable protective coveralls of claim 1, wherein the seams are selected from sewn seams, stitched seams, ultrasonically bonded seams, solvent welded seams, adhesively bonded seams, thermally bonded seams.

18. A method of making disposable protective coveralls having a reduced number of seams and a seamless shoulder construction, the method comprising:

providing a first body half and a second body half, each composed of a seamless sheet of material, said second body half being substantially a mirror image of said first body half, and each body half including:

a body portion having a first and second edge and a top edge extending approximately half-way across the body portion from the second edge;

a sleeve portion having a top and bottom sleeve edge, a top edge, and a segment of the second edge of the body portion; and a leg portion having a front and a rear leg edge;

folding each sleeve portion substantially in half down its length;

folding each body portion and leg portion substantially in half down their lengths;

attaching the top edge of a sleeve portion to the top edge of its respective body portion on each body half;

attaching the top sleeve edge to a respective bottom sleeve edge on a sleeve portion on each body half;

attaching the second edges of respective body portions of each body half;

attaching a closure means to respective first edges of each body half; and attaching the front leg edge to the back leg edge of respective leg portions on each body half.

19. The method of making disposable protective coveralls according to claim 18, further comprising the steps of attaching features selected from a collar, a hood, boots, and elastic cuffs.

20. The method of making disposable protective coveralls according to claim 18, wherein the attaching technique is selected from sewing, stitching, ultrasonic bonding, solvent welding, adhesive bonding and thermal bonding.

* * * * *